US010716353B2

(12) United States Patent
Vito et al.

(10) Patent No.: US 10,716,353 B2
(45) Date of Patent: Jul. 21, 2020

(54) PROTECTIVE HEADBAND

(71) Applicant: MATSCITECHNO LICENSING COMPANY, Kennett Square, PA (US)

(72) Inventors: Robert A. Vito, Kennett Square, PA (US); Michael Foerster, Newtown Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 0 days.

(21) Appl. No.: 14/262,935

(22) Filed: Apr. 28, 2014

(65) Prior Publication Data

US 2015/0257470 A1 Sep. 17, 2015

Related U.S. Application Data

(60) Provisional application No. 61/952,448, filed on Mar. 13, 2014.

(51) Int. Cl.

| | |
|---|---|
| ***A42C 5/02*** | (2006.01) |
| ***A63B 71/10*** | (2006.01) |
| ***A41D 20/00*** | (2006.01) |

(52) U.S. Cl.

CPC ..... *A42C 5/02* (2013.01); *A41D 20/00* (2013.01); *A63B 71/10* (2013.01); *A63B 2209/10* (2013.01); *A63B 2225/09* (2013.01)

(58) Field of Classification Search

CPC . A63B 71/10; A63B 2209/10; A63B 2225/09; A42B 3/00; A42B 3/12; A42B 3/125; A42B 3/14; A42B 3/142; A42B 3/145; A41D 20/00; A42C 5/02

USPC ... 2/410, 411, 412, 414, 417, 418, 425, 909, 2/DIG. 11, 171

See application file for complete search history.

(56) References Cited

U.S. PATENT DOCUMENTS

| | | | | |
|---|---|---|---|---|
| 1,237,048 A * | 8/1917 | Idoux | ..... | A42C 5/02 2/181.8 |
| 2,640,198 A * | 6/1953 | Mullen | ..... | A45D 44/12 2/174 |
| 3,714,668 A * | 2/1973 | Mirabella | ..... | A42B 3/145 2/419 |

(Continued)

FOREIGN PATENT DOCUMENTS

EP 2181735 A1 5/2010

OTHER PUBLICATIONS

International Search Report and Written Opinion issued in PCT/US2015/015590 dated May 27, 2015.

(Continued)

*Primary Examiner* — Anna K Kinsaul
*Assistant Examiner* — F Griffin Hall
(74) *Attorney, Agent, or Firm* — RatnerPrestia

(57) ABSTRACT

Protective headbands are disclosed. One protective headband has a padding layer that includes a pair of first portions extending in a first direction along a first axis, a second portion extending in the first direction and spaced from the first axis, and a pair of angled portions connecting between the pair of first portions and the second portion. Another protective headband has a padding layer that includes a pair of first arcuate portions, and a second arcuate portion extending between the pair of first arcuate portions, the second arcuate portion curving in a same direction as the pair of first arcuate portions.

6 Claims, 3 Drawing Sheets

(56) References Cited

U.S. PATENT DOCUMENTS 4,646,367 A * 3/1987 El Hassen ..... A42B 3/00 2/171
4,698,852 A * 10/1987 Romero ..... A42B 3/00 2/171
4,768,231 A 9/1988 Schrack
5,423,091 A * 6/1995 Lange ..... A45D 44/12 2/174
5,598,585 A * 2/1997 Stroup ..... A41D 20/00 132/273
5,608,917 A * 3/1997 Landis ..... A42B 3/14 2/11
5,946,734 A * 9/1999 Vogan ..... A42B 3/00 2/171
5,963,989 A * 10/1999 Robertson ..... A41D 20/00 2/171
6,000,062 A * 12/1999 Trakh ..... A41D 20/00 2/171
6,115,843 A * 9/2000 Travalgia ..... A41D 20/00 2/171
6,227,011 B1 * 5/2001 Cortinovis ..... A41D 20/00 2/171
6,266,826 B1 * 7/2001 Alfano ..... A42B 3/00 2/411
6,349,416 B1 2/2002 Lampe et al.
6,381,760 B1 5/2002 Lampe et al.
6,397,399 B1 6/2002 Lampe et al.
6,438,761 B1 * 8/2002 McGarrity ..... A42B 3/00 2/171
6,546,562 B2 * 4/2003 Cheng ..... A45D 8/36 2/171
6,565,461 B1 * 5/2003 Zatlin ..... A63B 71/10 2/411
6,625,820 B1 * 9/2003 Lampe ..... A42B 3/00 2/171
6,732,379 B2 * 5/2004 Lebherz ..... A42B 3/16 2/209
D572,880 S * 7/2008 Leedom ..... D2/891
7,562,658 B2 * 7/2009 Madaus ..... A61M 16/06 128/201.22
D655,420 S * 3/2012 Bowles ..... D24/206
D660,555 S * 5/2012 Stoltz ..... D2/892
8,904,567 B2 * 12/2014 Johnson ..... A42B 3/10 2/181.4
D736,394 S * 8/2015 Owoc ..... D2/894
2002/0069452 A1 * 6/2002 Knappl ..... A42B 3/00 2/411
2002/0166157 A1 * 11/2002 Pope ..... A42B 3/122 2/413
2002/0189004 A1 * 12/2002 Aaron ..... A42B 3/00 2/411
2004/0250340 A1 * 12/2004 Piper ..... A42B 3/064 2/411
2005/0204456 A1 9/2005 Piper et al.
2006/0059605 A1 * 3/2006 Ferrara ..... A42B 3/121 2/410
2006/0064798 A1 * 3/2006 Abraham ..... A42B 3/10 2/411
2007/0011796 A1 * 1/2007 Manzo ..... A41D 20/00 2/310
2009/0222975 A1 9/2009 Green et al.
2010/0101006 A1 * 4/2010 Cleveland ..... A42B 3/00 2/414
2016/0286888 A1 * 10/2016 Abraham ..... A42B 3/125

OTHER PUBLICATIONS

International Preliminary Report on Patentability and Written Opinion for International Application No. PCT/US2015/015590 dated Sep. 13, 2016, 11 pages.
Extended European Search Report for European Application No. 15761036.1, dated Nov. 7, 2017, 9 pages.

* cited by examiner

PROTECTIVE HEADBAND

CROSS REFERENCE TO RELATED APPLICATIONS

This application claims priority to U.S. patent application Ser. No. 61/952,448, entitled "PROTECTIVE HEADBAND," filed Mar. 13, 2014, the contents of which are incorporated herein by reference in their entirety.

FIELD OF THE INVENTION

The invention relates generally to the field of protective headgear, and more particularly, to impact-resistant padding for protective headbands.

BACKGROUND OF THE INVENTION

Conventionally, participants in "contact" sports (e.g., wrestling, football, rugby) wear protective headgear or headbands to cushion the force of impacts that are regularly received during those events. In recent years, the negative health effects of the impacts to the head experienced during such contact sports have been a matter of focus. These negative health effects can be diminished or minimized by effectively cushioning participants from the forces of impacts. Accordingly, improved structures, such as impact-resistant headbands, are desired to lessen the impact forces experienced by those participants.

SUMMARY OF THE INVENTION

Aspects of the invention are directed to protective headbands.

In accordance with one aspect of the present invention, a protective headband is disclosed. The protective headband has a padding layer. The padding layer includes a pair of first portions extending in a first direction along a first axis, a second portion extending in the first direction and spaced from the first axis, and a pair of angled portions connecting between the pair of first portions and the second portion.

In accordance with another aspect of the present invention, another protective headband is disclosed. The protective headband has a padding layer. The padding layer includes a pair of first arcuate portions, and a second arcuate portion extending between the pair of first arcuate portions, the second arcuate portion curving in a same direction as the pair of first arcuate portions.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

The embodiments of the invention described herein relate to protective headbands and padding that incorporate impact-resistant materials to cushion the force of impacts to a user's head. As used herein, the term "impact-resistant" is intended to encompass any object that partially or fully lessens, diminishes, dissipates, deflects, or absorbs the mechanical force of an impact.

The exemplary protective headbands disclosed herein are particularly suitable for use by participants in athletic activities, including traditional "contact" sports, such as wrestling, American football, or rugby, where high-force impacts may be commonly experienced. While the exemplary embodiments of the invention are described herein with respect to athletic activities, it will be understood that the invention is not so limited. Suitable applications for the headbands of the present invention also include military helmets or construction helmets. Other suitable applications will be readily understood by one of ordinary skill in the art from the description herein.

Figure 1:
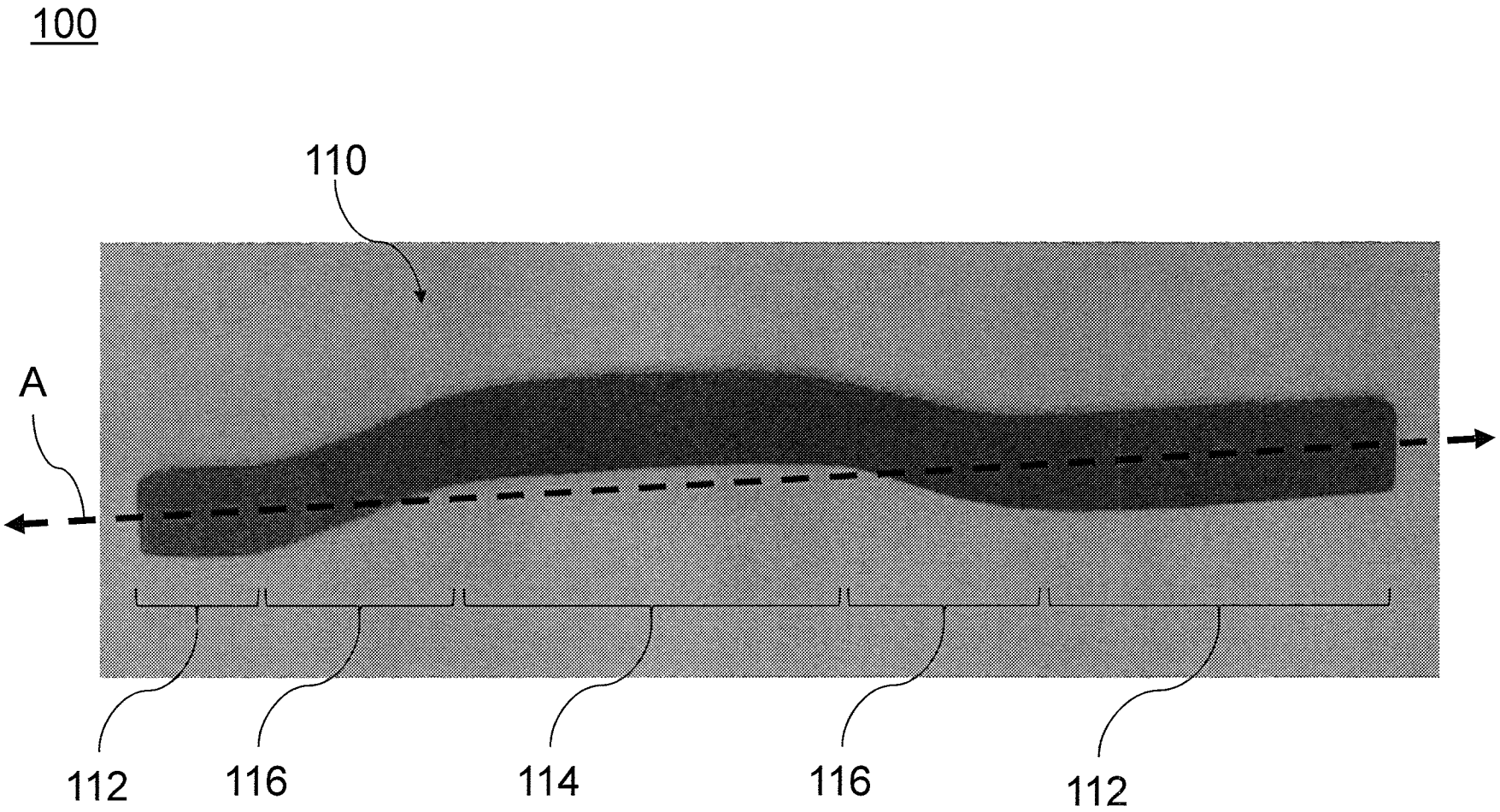
FIG. 1 is a diagram illustrating an exemplary protective headband in accordance with aspects of the present invention.

Referring now to the drawings, FIG. 1 illustrates an exemplary protective headband 100 in accordance with aspects of the present invention. Headband 100 may be worn by a user during an athletic activity. Headband 100 may desirably be worn underneath one or more other pieces of protective headgear. As a general overview, headband 100 includes a padding layer 110. Additional details of headband 100 are described herein.

Padding layer 110 forms the body of headband 100. As shown in FIG. 1, padding layer 110 comprises a pair of first portions 112 extending in a first direction along an axis A. Further, padding layer 110 further comprises a second portion 114 extending in the same, first direction. As shown in FIG. 1, second portion 114 is spaced from axis A. Still further, padding layer 110 comprises a pair of angled portions 116 connecting between the first portions 112 and second portion 114. As shown in FIG. 1, angled portions 116 extend in an oblique direction relative to the first direction.

Padding layer 110 is formed from impact-resistant materials. For example, padding layer 110 may include a layer of elastomeric material. The elastomeric material may provide impact-resistance by absorbing and dissipating the force of impacts laterally along the surface of the elastomeric material. In one exemplary embodiment, padding layer 110 consists of only a single layer of elastomeric material. In another exemplary embodiment, padding layer 110 comprises two or more layers of elastomeric material. Padding layer 110 may include the layers of elastomeric material directly adjacent each other, or in a more preferred embodiment, may include a layer of high tensile strength fibrous material between the layers of elastomeric material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high tensile strength fibrous material include, but are not limited to, aramid fibers, fiberglass, or other high tensile strength fibers. The fibers may be woven to form a cloth layer that is disposed between and generally separates the opposing elastomeric layers. The high tensile strength fibrous material layer may desirably block and redirect impact energy that passes through one of the elastomeric layers. Additional description of materials for forming padding layer 110 may be found in U.S. patent application Ser. No. 09/978,130, the contents of which are incorporated herein by reference in their entirety for all purposes.

The materials and thickness of padding layer 110 can be selected such that padding layer 110 remains sufficiently flexible to allow the protective headband to maintain contact with a user's head along an entire circumference of the user's head. In an exemplary embodiment, padding layer 110 has a thickness of less than approximately 0.5 inches.

Additionally, the order of materials in padding layer 110 may be important for providing optimal protection to the user. In an exemplary embodiment in which padding layer 110 includes a layer of elastomeric material and a layer of high-tensile strength fibrous material, the layer of high-tensile strength fibrous material is positioned closer to the user than the layer of elastomeric material. This may desirably protect the layer of high-tensile strength fibrous material from rips, tears, or punctures, as it may be more susceptible to such damage than the layer of elastomeric material.

It has been determined that headband 100 provides the greatest protection, and that the comfort of the user of headband 100 is enhanced, when second portion 114 is positioned over the user's lower forehead during use. Accordingly, angled portions 116 are desirably sized and shaped to position second portion 114 in the optimal position during use of headband 100. Additionally, second portion 114 may have a width that is greater than a width of the first portions 112 of padding layer 110 in order to provide greater protection to the user's forehead.

In a preferred embodiment, angled portions 116 extend at an angle between approximately 15° and approximately 23° relative to the first direction (along which extend first portions 112). In a more preferred embodiment, angled portions 116 extend at an angle between approximately 17° and approximately 21° relative to the first direction. Through extensive testing, the inventors have determined that these angular ranges provide the optimal balance of protection and comfort to the user of headband 100.

In another preferred embodiment, angled portions 116 have a length of between approximately 2-4 inches, and second portion 114 has a length of between approximately 4-7 inches. The particular lengths of second portion 114 and angled portions 116 may be selected based on the size of the user's head. Second portion 114 is preferably spaced from the first axis A by a distance of between approximately 0.5-2.0 inches.

As shown in FIG. 1, second portion 114 has a substantially straight shape (i.e., is substantially parallel to axis A). However, it will be understood that the invention is not so limited. In an alternative embodiment, second portion 114 may have a substantially arcuate shape (i.e., second portion 114 may be curved toward first axis A).

Figure 2:
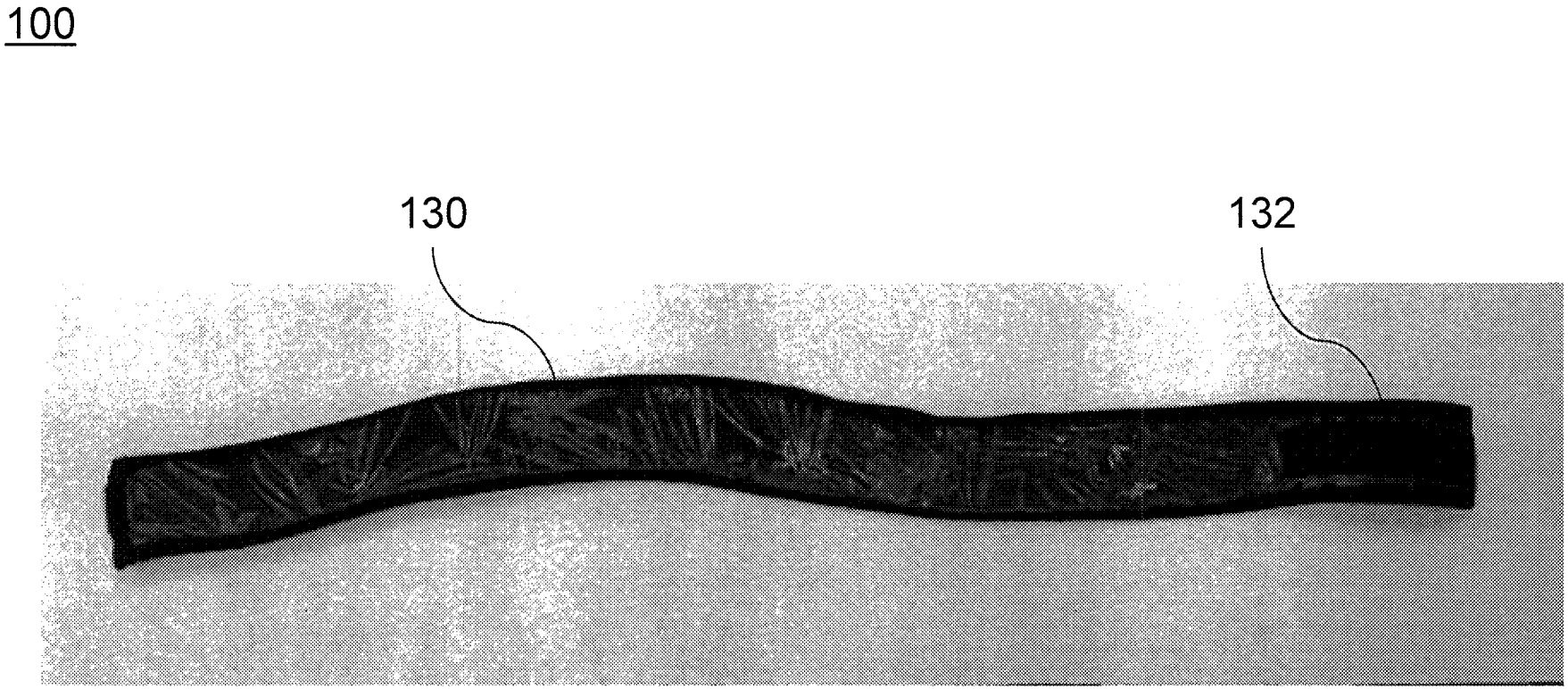
FIG. 2 is a diagram illustrating the exemplary protective headband of FIG. 1 with a fabric cover.

FIG. 2 shows protective headband 100 with an exemplary fabric layer 130 in accordance with aspects of the present invention. Fabric layer 130 is configured to surround padding layer 110. Fabric layer 130 may desirably provide a more comfortable feeling for the user of headband 100 than directly contact with padding layer 110.

As shown in FIG. 2, fabric cover 130 may comprise at least one attachment mechanism 132 for attaching an end of one of the first portions 112 of padding layer 110 to the end of the other first portion 112 of padding layer 110. In an exemplary embodiment, attachment mechanism 132 comprises a hook and loop fastener. Alternative attachment mechanisms will be known to those of ordinary skill in the art. Examples of such mechanisms include buttons, snaps, buckles, clasps, etc. Attachment mechanism 132 desirably enables headband 100 to be adjustable in circumference to allow headband to snugly and comfortably fit on the user's head during use.

Figure 3:
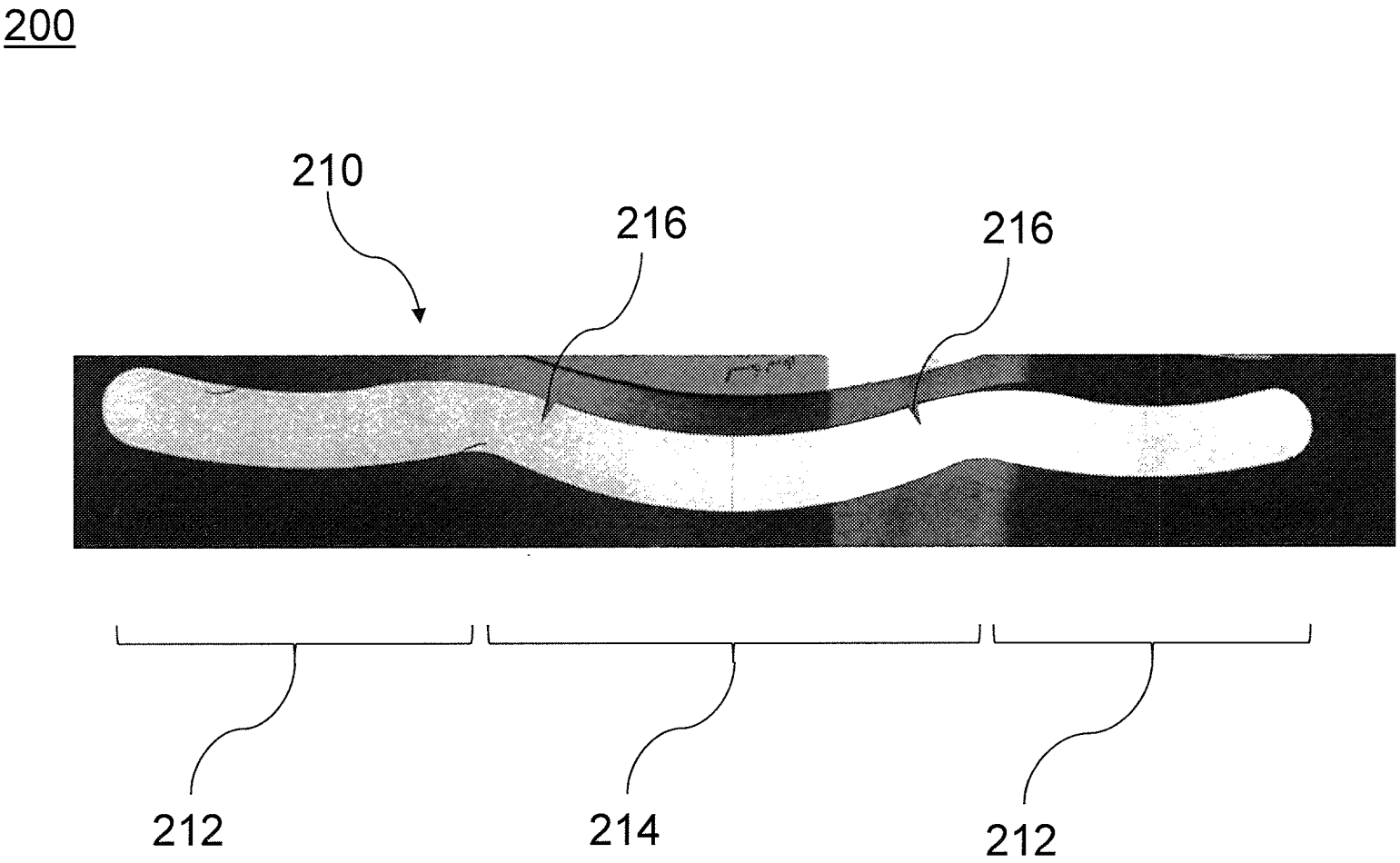
FIG. 3 is a diagram illustrating another exemplary protective headband in accordance with aspects of the present invention.

FIG. 3 illustrates another exemplary protective headband 200 in accordance with aspects of the present invention. Headband 200 may be worn by a user during an athletic activity. Headband 200 may desirably be worn underneath one or more other pieces of protective headgear. As a general overview, headband 200 includes a padding layer 210. Headband 200 includes substantially the same features of headband 100 except as described below.

As shown in FIG. 3, padding layer 210 comprises a pair of first arcuate portions 212, each first arcuate body portion having opposed upper and lower arcuate edges, and a second arcuate portion 214 extending between the pair of first arcuate portions 212, second arcuate portion 214 having opposed upper and lower arcuate edges. Second arcuate portion 214 is curved in the same direction as the pair of first arcuate portions 212 (e.g., a counter-clockwise curve from left to right in FIG. 3). Padding layer 210 may be formed from any of the impact-resistant materials described above with respect to padding layer 110.

It has been determined that headband 200 provides the greatest protection, and that the comfort of the user of headband 200 is enhanced, when second arcuate portion 214 is positioned over the user's lower forehead during use. Accordingly, the length and radius of curvature of second arcuate portion 214 are desirably selected to place second arcuate portion 214 in the optimal position during use of headband 200.

In a preferred embodiment, second arcuate portion 214 has a different radius of curvature than the pair of first arcuate portions 212. For example, second arcuate portion 214 may have a radius of curvature between approximately 9-12 inches, and first arcuate portions 212 may have a radius of curvature between approximately 7-10 inches. Through extensive testing, the inventors have determined that these radii of curvature provide the optimal balance of protection and comfort to the user of headband 200. In particular, headband 200 desirably conforms more tightly to the user's head during athletic activities, and may increase compression on the head to prevent accidental dislodgement during athletic activities.

Padding layer 210 may further comprise one or more notches 216. Notches 216 can be formed at one or both ends of second arcuate portion 214. Notches 216 are formed on the inside of the curve of second arcuate portion 214 (i.e., on the top side in FIG. 3). Notches 216 desirably allow padding layer 210 to better contour to the user's head during athletic activities, thereby providing better protection and a decreased change of dislodgement.

In an exemplary embodiment, notches 216 have a triangular shape, as shown in FIG. 3. However, it will be understood to one of ordinary skill in the art that the shape of notches 216 shown in FIG. 3, is illustrative, and is not intended to be limiting. Other suitable shapes for notches 216 will be known to one of ordinary skill in the art from the description herein.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

What is claimed:

1. A headband, the headband having a padding layer having a surface configured to face a user's head when the headband is worn by the user, the surface of the padding layer having a length extending in a length direction and a width extending in a width direction, the width shorter than the length, the padding layer consisting of: a pair of first arcuate body portions, each first arcuate body portion having opposed upper and lower arcuate edges, each of the opposed upper and lower arcuate edges curving in the width direction of the surface of the padding layer; and a second arcuate body portion extending from a first end of one of the pair of first arcuate body portions to a first end of the other of the pair of first arcuate body portions, the second arcuate body portion having opposed upper and lower arcuate edges, the opposed upper and lower arcuate edges of the second arcuate body portion curving in the width direction of the surface of the padding layer, wherein the opposed upper and lower arcuate edges of each of the pair of first arcuate body portions curve in a same arcuate direction, and the opposed upper and lower arcuate edges of the second arcuate body portion all curve in the same arcuate direction as the opposed upper and lower arcuate edges of each of the pair of first arcuate body portions; wherein the upper arcuate edge of the second arcuate body portion is notched at both ends of the second arcuate body portion, and wherein each of the notches in the upper arcuate edge of the second body portion has a triangular shape.

2. The headband of claim 1, wherein the opposed upper and lower arcuate edges of the second arcuate body portion have a radius of curvature in the width direction different from a radius of curvature in the width direction of the opposed upper and lower arcuate edges of the pair of first arcuate body portions.

3. The headband of claim 2, wherein the radius of curvature of the second arcuate body portion is between 9-12 inches.

4. The headband of claim 2, wherein the radius of curvature of the pair of first arcuate body portions is between 7-10 inches.

5. The headband of claim 1, wherein the padding layer is sufficiently flexible to maintain contact with the user's head along an entire circumference of the user's head.

6. The headband of claim 1, wherein the upper arcuate edges of each of the pair of first arcuate body portions and the upper arcuate edge of the second arcuate body portion all curve in a counter clockwise direction along the length of the padding layer, and the lower arcuate edges of each of the pair of first arcuate body portions and the lower arcuate edge of the second arcuate body portion all curve in the counter clockwise direction along the length of the padding layer.

* * * * *